US006530500B2

(12) United States Patent
Bravo et al.

(10) Patent No.: US 6,530,500 B2
(45) **Date of Patent: *Mar. 11, 2003**

(54) STORAGE AND DISPENSING CONTAINER FOR VISCOUS FLUIDS, PAINTS AND THE LIKE, AND METHOD OF MINIMIZING DRIPPING

(75) Inventors: Michael H. Bravo, Needham, MA (US); Craig M. Rowles, W. Hartford, CT (US); John P. Sullivan, Ontario (CA); David Markham, Pittsford, NY (US); Mark W. Scott, Bethany, CT (US); Chris Van Buiten, Oxford, CT (US); Gregory J. Mascoli, F. Haddam, CT (US); Robert Slack, Jupiter, FL (US); Corinna Lee, Laca, CA (US)

(73) Assignee: The Sherwin-Williams Company, Cleveland, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/349,894

(22) Filed: Jul. 8, 1999

(65) Prior Publication Data

US 2001/0025865 A1 Oct. 4, 2001

(51) Int. Cl.[7] ..... B65D 21/00

(52) U.S. Cl. ..... 222/143; 220/837; 222/568; 222/571; 215/305

(58) Field of Search ..... 222/571, 568, 222/567, 556, 561, 143; 215/305, 304; 220/837

(56) References Cited

U.S. PATENT DOCUMENTS

| | | | | |
|---|---|---|---|---|
| D34,895 | S | | 8/1901 | McFaddin |
| 2,194,486 | A | * | 3/1940 | Straub ..... 222/561 |
| 2,324,338 | A | * | 7/1943 | Tripp ..... 222/571 X |
| 2,659,519 | A | * | 11/1953 | Allen ..... 222/567 |
| 2,707,574 | A | * | 5/1955 | Klebenow ..... 222/571 |
| 2,743,844 | A | * | 5/1956 | Livingstone ..... 222/571 X |
| 2,763,402 | A | | 9/1956 | Livingstone ..... 222/109 |
| 2,817,465 | A | * | 12/1957 | Gray ..... 222/571 |
| 2,851,196 | A | | 9/1958 | Livingstone ..... 222/111 |
| 3,000,527 | A | | 9/1961 | Jennings et al. ..... 215/100 |
| D192,886 | S | | 5/1962 | Kaplan ..... D58/5 |
| D206,407 | S | | 12/1966 | Sharp ..... D58/5 |
| 3,310,088 | A | | 3/1967 | Hildebrandt et al. ..... 150/0.5 |
| D207,466 | S | | 4/1967 | Phillips ..... D58/17 |
| 3,313,438 | A | | 4/1967 | Piker ..... 215/13 |
| 3,387,749 | A | * | 6/1968 | Godshalk et al. ..... 222/143 |
| D211,928 | S | | 8/1968 | Burnett ..... D9/44 |
| D217,231 | S | | 4/1970 | Pashman ..... D9/239 |
| D221,515 | S | | 8/1971 | Betka ..... D9/40 |
| 3,612,595 | A | | 10/1971 | Updegraff et al. ..... 294/31.2 |
| 3,620,410 | A | | 11/1971 | Griese, Jr. ..... 220/94 R |

(List continued on next page.)

OTHER PUBLICATIONS

Copyright 1990 The Financial Times Limited Financial Times (London)—Jan. 4, 1990—3 pages.
Copyright 1994 Information Access Company, a Thomson Corporation Company—Oct. 13, 1994.

*Primary Examiner*—Henry C. Yuen
*Assistant Examiner*—John Bastianelli
(74) *Attorney, Agent, or Firm*—Rines and Rines; Paul R. Katterle; Robert E. McDonald

(57) ABSTRACT

An improved container for storing, dispensing and handling viscous and semi-viscous fluids such as paint and the like, having novel spout and other design features that enable substantially dripless dispensing and improved handling and storage

30 Claims, 5 Drawing Sheets

U.S. PATENT DOCUMENTS 3,625,386 A * 12/1971 Schaefer ..... 215/46
3,659,758 A * 5/1972 Waterman ..... 222/561
3,695,488 A 10/1972 Olsson ..... 222/570
3,727,792 A 4/1973 Levin ..... 220/90
3,744,671 A 7/1973 Saunders, Jr. ..... 220/90
3,807,679 A 4/1974 Burke et al. ..... 248/359
3,899,107 A 8/1975 Gaal ..... 222/570
3,945,527 A 3/1976 Pylant ..... 220/90
4,014,465 A * 3/1977 Ritter
4,022,352 A * 5/1977 Pehr ..... 222/556 X
4,061,242 A 12/1977 Donlon ..... 220/90
4,078,700 A * 3/1978 Hidding ..... 222/571 X
4,128,189 A 12/1978 Baxter ..... 222/109
D250,806 S 1/1979 Gutkowski ..... D9/39
4,150,763 A 4/1979 Simpson ..... 220/90
4,203,537 A 5/1980 McAlister ..... 222/570
4,225,064 A 9/1980 Westcott ..... 222/569
4,240,568 A 12/1980 Pool ..... 222/189
D258,563 S 3/1981 Romagnoli ..... D9/376
D261,362 S 10/1981 Epperson ..... D9/376
4,312,459 A 1/1982 Leach ..... 220/256
4,387,828 A 6/1983 Yates, Jr. ..... 220/284
4,387,922 A 6/1983 Geisinger ..... 294/31.2
D269,948 S 8/1983 Janssen ..... D9/375
4,399,926 A 8/1983 Eidels-Dubovoy ..... 220/288
4,457,458 A * 7/1984 Heinol ..... 222/545 X
4,458,819 A * 7/1984 Geiger ..... 215/224
D276,890 S 12/1984 Hancher ..... D9/376
4,491,234 A 1/1985 Wilcock ..... 220/90
4,520,936 A 6/1985 Lyons ..... 215/1 C
D279,763 S 7/1985 Hestehave et al. ..... D9/375
4,548,332 A 10/1985 Neat ..... 220/268
D281,579 S 12/1985 Drummond, Jr. et al. .... D9/376
4,583,666 A 4/1986 Buck ..... 222/109
D289,377 S 4/1987 Ashby et al. ..... D9/378
4,664,295 A * 5/1987 Iida ..... 222/571 X
4,671,421 A 6/1987 Reiber et al. ..... 215/228
4,706,829 A 11/1987 Li ..... 215/354
4,736,874 A 4/1988 Durant ..... 222/570
D296,873 S 7/1988 Dent et al. ..... D9/401
4,773,560 A 9/1988 Kittscher ..... 222/109
4,805,793 A * 2/1989 Brandt et al. ..... 222/143 X
4,830,234 A 5/1989 Odet ..... 222/465.1
D304,014 S 10/1989 O'Connell ..... D9/372
D305,407 S 1/1990 Gonda ..... D9/376
4,893,723 A 1/1990 Seabolt ..... 220/85
4,911,319 A 3/1990 DeJean ..... 220/4 A
4,917,268 A * 4/1990 Campbell et al. .... 222/153.1 X
4,927,046 A 5/1990 Armstrong ..... 220/90
4,941,815 A 7/1990 Julian ..... 425/525
4,949,884 A * 8/1990 Dahl ..... 222/571 X
4,974,749 A * 12/1990 Mon ..... 222/571 X
D313,350 S 1/1991 Beaver ..... D9/376
4,984,714 A 1/1991 Sledge ..... 222/109
4,993,605 A 2/1991 Del'Re ..... 222/545
5,020,692 A 6/1991 Darr ..... 222/109
D318,228 S 7/1991 Schlesselman ..... D9/372
D320,345 S 10/1991 Hamly et al. ..... D9/372
D321,624 S 11/1991 Fiore et al. ..... D7/321
D323,115 S 1/1992 Kelsey ..... D9/423
5,092,474 A 3/1992 Leigner ..... 215/1 C
5,108,009 A * 4/1992 Davidson et al. ..... 222/571 X
D332,747 S 1/1993 Darr et al. ..... D9/520
5,188,249 A 2/1993 Cargile ..... 215/31
5,207,356 A 5/1993 Krall ..... 222/109
D336,434 S 6/1993 Binder ..... D9/528
D338,407 S 8/1993 Lynd ..... D9/531
5,234,130 A 8/1993 Benioff et al. ..... 222/111
5,269,438 A * 12/1993 Kelsey ..... 222/567 X
5,299,710 A 4/1994 Welsch et al. ..... 220/675
5,322,662 A 6/1994 Benioff et al. ..... 264/533
D349,651 S 8/1994 Saffer ..... D9/528
D352,459 S 11/1994 Pollacco ..... D9/528
5,377,858 A 1/1995 Morris, Sr. ..... 220/254
D355,366 S 2/1995 Bainton ..... D9/532
5,390,805 A * 2/1995 Bilani et al. ..... 222/556 X
D358,333 S 5/1995 Stockwell et al. ..... D9/531
5,431,306 A 7/1995 Reid ..... 222/111
D362,180 S 9/1995 Haines ..... D9/424
D370,153 S 5/1996 Chaney et al. ..... D7/511
D370,850 S 6/1996 Beaver ..... D9/543
D372,197 S 7/1996 Gough ..... D9/532
D374,178 S 10/1996 Valls et al. ..... D9/523
5,566,861 A 10/1996 Serano ..... 222/109
5,566,862 A 10/1996 Haffner et al. ..... 222/111
5,577,626 A * 11/1996 Henkel et al. ..... 215/305 X
D376,761 S 12/1996 Lathrop et al. ..... D9/528
5,603,787 A 2/1997 Reid ..... 156/73.1
D379,302 S 5/1997 Rodman ..... D9/440
5,626,258 A 5/1997 Maiorino ..... 220/695
5,669,526 A * 9/1997 Keyfauver ..... 222/569 X
5,678,684 A 10/1997 Wright ..... 206/204
D389,067 S 1/1998 Lown ..... D9/543
5,704,502 A * 1/1998 Greenfield ..... 215/305 X
D392,188 S 3/1998 Darr et al. ..... D9/520
5,794,803 A 8/1998 Sprick ..... 215/217
5,823,345 A 10/1998 Nask et al. ..... 206/509
D401,154 S 11/1998 Robinson ..... D9/528
D403,243 S 12/1998 Takeuchi et al. ..... D9/532
5,850,953 A * 12/1998 Dallas, Jr. ..... 222/568 X
5,855,299 A 1/1999 Arnold et al. ..... 222/109
5,855,304 A 1/1999 Dean et al. ..... 222/481
5,868,283 A 2/1999 Wilson et al. ..... 222/111
5,875,942 A * 3/1999 Ohmi et al. ..... 222/556
5,893,489 A * 4/1999 Giarrante ..... 222/556 X
5,896,993 A 4/1999 Nask et al. ..... 206/508
5,941,427 A * 8/1999 Speer ..... 222/569 X
5,964,383 A * 10/1999 Cargile ..... 222/571
5,975,346 A 11/1999 Imperato et al. ..... 220/831
6,029,858 A 2/2000 Srokose et al. ..... 222/143
D422,920 S 4/2000 Tapp et al. ..... D9/530
6,059,153 A 5/2000 Olson et al. ..... 222/465.1
6,068,161 A 5/2000 Soehnlen et al. ..... 222/143
6,085,949 A 7/2000 Zimny et al. ..... 222/572
D428,817 S 8/2000 Olson et al. ..... D9/531
6,123,231 A 9/2000 Geisinger ..... 222/109
6,209,762 B1 4/2001 Haffner et al. ..... 222/570
6,223,945 B1 5/2001 Giblin et al. ..... 222/109
D449,535 S 10/2001 Geisinger et al. ..... D9/525

* cited by examiner

Lid (16)

Jug Body (24)

STORAGE AND DISPENSING CONTAINER FOR VISCOUS FLUIDS, PAINTS AND THE LIKE, AND METHOD OF MINIMIZING DRIPPING

The present invention relates to containers for viscous and other fluids and to improvements in the containment, dispensing and handling of the fluids, being more particularly, though not exclusively, concerned with architectural coatings such as paints and the like and to significant improvement in current paint can design.

BACKGROUND

Nearly all one-gallon and smaller containers of paint are sold in cylindrical metal cans having an upper edge with a groove that accepts the annular protrusion of a high friction metal lid secured by a press fit. This arrangement has many operational drawbacks that the industry has put up with for many decades. These include the lack of a locking mechanism that would prevent the friction lid, popping off if the can is dropped from a height as little as one meter, with consequent spilling of the contents widely on the ground. The lid, moreover, must be pried off with a tool to gain access to the paint, which proves a problem if no tool is available. The prying action, moreover, often damages the lid sealing surface. The can lip, furthermore, makes a very poor spout. When the paint contents are transferred to another container, they must be poured across the grooved upper edge of the can, which inherently retains some of the paint, and the paint running down the outside of the can often obscure the label, potentially reaching the users hands and the bottom surface. The can, indeed, must be wiped nearly every time it is poured. With the inside of the upper rim trapping paint as it is poured, the user is never able to extract all available paint even if a brush is used. The circular shape of the can opening, in addition, is ineffective for wiping a flat brush clean of excess paint. Every time paint is poured from a can, the groove that accepts the lid fills with paint and it is very difficult to clean completely. After repeated opening, pouring, and closing, in addition, the mating surface becomes fouled and the friction seal fails.

Perhaps the biggest drawback of the current paint can, however, resides in the splattering of paint from the groove as the lid is pounded back on. The pounding of the lid often damages both sealing surfaces, which again can cause the seal to fail. Furthermore, paint in and around the groove can dry out and flake, leading to paint contamination each time the can is jostled. While metal cans are coated to prevent rust, this coating often fails, which leads to rust and paint contamination. Paint cans, in addition, do not stack well, and little disturbance is needed to cause them to slide off of one another.

Many efforts have been made to address these and other problems associated with the conventional metal paint can. Some prior are improvements remedy to some degree some of the shortcomnings mentioned above, but none, until the present invention, has effectively solved even a majority of these problems.

As an example, U.S. Pat. No. 5,669,526 discloses a plastic paint can that has a small-diameter, collapsible spout, non-contaminating lid seal, and straight edge formed in the can opening to facilitate brush wiping. This configuration, however, only addresses problems of paint contamination, messy pouring, and non-uniform brush wiping inherent in the conventional metal paint can. The narrow spout opening causes a slow pour rate and an undesirable chugging action as contents are poured.

U.S. Pat. No. 5,269,438 discloses a container with features designed to improve dispensing, such as a pivotally mounted carrying handle that is offset from the opening to provide access. It also has a wide pouring channel to improve flow, addressing to some degree a number of deficiencies. The pop top of the lid, however, is not very secure and the spout does not prevent paint running down the side of the container.

A plastic container having a threaded lid that closes the container either by screw-down or snap-on action is proposed in U.S. Pat. No. 4,453,647. A depression is formed in the lid to accept a mixing stick or the like to aid in tightening and undoing the lid. This configuration, however, only addresses the problems of paint contamination and the difficult opening and closing of the lid inherent in the conventional metal paint can. As the contents are poured, they can still coat container threads and run down the side of the container. A tool, in particular a paint mixing stick, not always available, is required, moreover, to open the lid.

In U.S. Pat. No. 4,917,268, there is disclosed a liquid-dispersing package with a spout that has a drain back channel to return liquid drips to the container. This configuration, however, only addresses the problem of difficult, messy pouring inherent in containers intended for dispensing low viscosity liquids, but it does not work will with moderate viscosity fluids, such as paint The tall and narrow design, moreover, eliminates the stackability of the container.

U.S. Pat. No. 5,054,661, as another illustration of attempts to improve the pouring operation, discloses a pouring spout that extends outwardly of the upper edge of the container, and an opposing handle projected from the upper edge of the container. It is also primarily intended to facilitate dispensing of paint during painting. In this invention, however, there is also no means to store the paint, and any unintended spillage during pouring will also wet exterior surfaces.

U.S. Pat. No. 4,619,373 discloses a plastic paint container with a lid that seals within the inner diameter of the rim at the top of the container, to eliminate the poor sealing characteristics of the friction lid of the metal paint can. It is still subject, however, to contamination of the seal by the paint itself, and does not provide for clean use or dispensing.

Another proposal, in U.S. Pat. No. 4,245,753 also provides a plastic paint container, but with a snap-on, screw-off type of lid. It also provides a stacking construction and a hollow handle. The design addresses the sealing and opening/closing problem with the metal paint can friction lid, and aids in stacking containers together. Like the other prior art, however, it does not provide for clean dispensing or use, nor does it address the difficulty that would be encountered with hand rotation of a firmly engaged, large diameter friction seal lid Numerous other prior art proposals provide for attaching auxiliary components to existing metal cans. Attachments are inherently deficient because they all require the additional operations of the attachment, removal, and cleaning which are inconvenient to the user. For example, U.S. Pat. No. 4,702,395 discloses a handle and pouring-spout arrangement intended for attachment to a conventional metal paint can. The spout has an optional paint-drainback section. This configuration, moreover, only attempts to solve the problem of difficult, messy pouring from conventional metal paint cans.

In U.S. Pat. No. 4,949,884, as another illustration, a removable top to a conventional metal can is proposed to attempt to solve these problems of difficult, messy pouring from conventional paint cans. Again, it must be attached and removed not only for every opening and closing, respectively, but also every time a brush is to be used.

While the above-mentioned advances in the art each solve to some degree some of the major problems inherent in the conventional metal paint can, none of them solves a majority of the problems. Some, moreover, improve only a subset of the problems and make improvements at the expense of some current favorable can features. The present invention, on the other hand, synergistically solves nearly all of the major problems above-enumerated inherent in the conventional metal paint can.

OBJECTS OF INVENTION

A primary object of the invention, accordingly, is to provide a new and improved paint container and the like embodying a novel method or technique for minimizing paint dripping and in addition simultaneously obviating the other previously described handling and operational disadvantages of current paint can containers.

An additional object is to provide an improved container with a novel spout design and recessed lid with flip out handle, retractable, insertable, and swing handle variations being also available.

A further object is to provide improved containers for containing, dispensing and handling fluids, generally.

Other and further objects will be explained hereinafter and are more particularly delineated in the appended claims.

SUMMARY

In summary, from one of its important viewpoints, the invention embraces an improved storage and dispensing hollow container body for fluids such as paint and the like, having, in combination, a top circular externally threaded collar for receiving a cooperatively interiorly threaded lid, the collar being interiorly provided with a substantially semi-circular concentric thin spout spaced inwardly thereof with a depending concentric drip-catch groove gap therebetween and along the spout, the spout extending upwardly above the collar to enable pouring of the fluid over the spout rearwardly of the collar threads, but with the height of such extension accomodatable within the lid when in threaded closure engagement with the collar to seal the fluid in the container body.

In its objective for improving the dispensing, containment, and handling of fluids such as architectural coatings and the like, the invention has been particularly optimized for paints, wherein dispensing involves the opening, distribution of contents by pouring or extracting with a scoop or brush, cleaning, and closing of the container. Current paint cans, as before explained, require the use of tools such as a screwdriver or the like for opening the lid. Screwdrivers often damage paint can lids and ruin the can seal. Prying open the lid becomes more difficult, furthermore, the more the can is used. It is much easier to open the lid of the present invention because it is screwed on, and has built-in leverage to tighten and loosen it, and has design features in the opening and spout of the container to prevent the threads from getting contaminated with the fluid from inside. No additional tools are needed, and the handles that are provided for leverage fully retract within, or are already integrally part of the container. Once the lid is rotated approximately one third of a turn, the friction seal is released and little resistance is left. An additional recessed lid grip is then used quickly and easily to unscrew the lid the rest of the way, until open.

Contents poured from conventional paint cans flow into the friction lid trough on the top surface of the can, as also earlier mentioned. Fluid has to be cleaned from the trough before closing. This is an undesirable task and is very difficult to do such that the friction lid still seals completely. Often fluid left in the trough is splattered all over the user during closing by pounding on the friction lid. Paint poured from paint cans tends to coat the exterior of the can by dribbling over the edge. This covers up important information printed on the label. In some cases, the paint runs down the side of the can and onto the floor causing a big mess. In general, pouring paint from a paint can is a messy unsatisfactory process.

The present invention, in summary, substantially eliminates paint from reaching the exterior surface of the container during pouring through its spout design that is optimized essentially to eliminate dripping onto the container exterior, specifically on the threads or label. Its unique shape minimizes dribble over the spout, and a non-draining groove or trough behind the spout traps what little dribble may somewhat occur. Pouring, in accordance with the invention, is thus a vastly cleaner operation that requires little or no clean-up before closing.

The invention also improves pouring accuracy and comfort, as well. The novel spout pours more uniformly than the paint can. The fluid stream is narrower and more cylindrical. This enables more accurate pouring. The use of the integral handle and swing handle during pouring is more comfortable than holding a paint can by the bail and can bottom. The handles also provide better control, which also improves pouring accuracy.

The design of the present invention, furthermore, improves dispensing of paint by brush. A brush is typically wiped on one or both sides to remove excess paint after it is dipped into the can. When a brush is wiped against the cylindrical opening of a conventional paint can, only excess paint from the edges is removed. The invention provides two straight wiping edges at the back of the opening at right angles to each other. Being straight, these surfaces remove excess paint uniformly from the brush as it is wiped. The edges being only 90 degrees apart, makes the wiping of both sides more convenient with less hand motion due to being closer together. A brush wiped against a conventional paint can opening must be moved across the entire opening, which is less convenient.

Many users, moreover, hold paint cans as they brush. The bail and associated can geometry is uncomfortable. The integral handle of the invention, on the other hand, can be held in two positions. One method is to grasp the handle as one would any vertical handle, such as one commonly seen on a plastic gallon milk jug. The other method is to put one's fingers through the integral handle, palm towards the jug, and grasp the container with the hand. Each method is significantly more comfortable than holding the current paint can.

The width-to-height aspect ratio of the preferred form of container of the invention is approximately the same as for a paint can in the side-to-side dimensions. Diagonally, corner to corner, the aspect ratio of the container of the invention is lower, which increases stability on inclined surfaces.

As before intimated, current paint cans may require a hammer or similar tool for closing. This often damages the friction lid and ruins the seal. As mentioned before, paint splatter is common due to paint left in the trough. After sufficient drying time between repeated uses, dried paint can completely foul the friction lid seal and render the paint can useless for storage. If the lack of seal is not identified by the user, the contents may congeal or solidify in storage. Closing and resealing the container of the invention is vastly improved since its threads and sealing surfaces remain clean after use. As a result, it will store fluids longer and keep them from becoming contaminated or drying out. The spout and screw on the lid design, in addition, eliminates any pooling of paint that could cause splattering or fouling of the seal. The built-up flip out lid handle, recessed lid grip, and integral handle in its body eliminate the need for any tools for closing.

The design of the container of the invention also improves containment. Fouling of the seal is eliminated and thus preservation of contents is assured. The improved sealing features of the device ensure endurance of the paint quality. The container is preferably of plastic, so the formation of rust, which is common on paint cans, is eliminated. The invention also has a splash seal inside its lid that isolates the container opening from the spout and sealing surfaces. This seal blocks paint from reaching the gasket seal and spout container handling and shaking. By keeping these two items free of paint, seal integrity and clean pouring are respectively maintained far better that with the current paint can.

Stacking security is also improved by the preferred use of a locator ring on the bottom of the container of the invention, which mates with a corresponding groove molded into the top of the lid. This enables the container to be stacked on top of one other in a laterally locked state, which greatly improves stability over the current can.

Hand transport and general handling of the containers of the invention is also superior to paint cans. The user has a choice of using the integral body handle or an exterior, rigid swing handle depending on the situation. The rigid swing handle offers the same conveniences as the bail on paint cans. The integral handle is more comfortable, sturdy, and offers more control over the paint jug when it is full.

If desired, moreover, a flexible swing handle can replace the rigid swing handle, as later discussed. This offers the capability to rotate the position of the handle around the opening as desired. The flip out handle can be replaced by either a built-in sliding handle or a hole in the side of the lid. The sliding handle works essentially the same way as the flip-out handle, except instead of rotating about a hinge, it slides on integral tracks. The version with the hole is perpendicular to the lid axis of rotation and large enough to accept a tool such as a screwdriver. The bit end of the screwdriver is slid into the hole. The screw driver handle can then be used as a lever to twist open the lid.

DRAWINGS

The invention will now be described in connection with the accompanying drawings, in which.

DESCRIPTION OF PREFERRED EMBODIMENT (S) OF INVENTION

Figure 1:
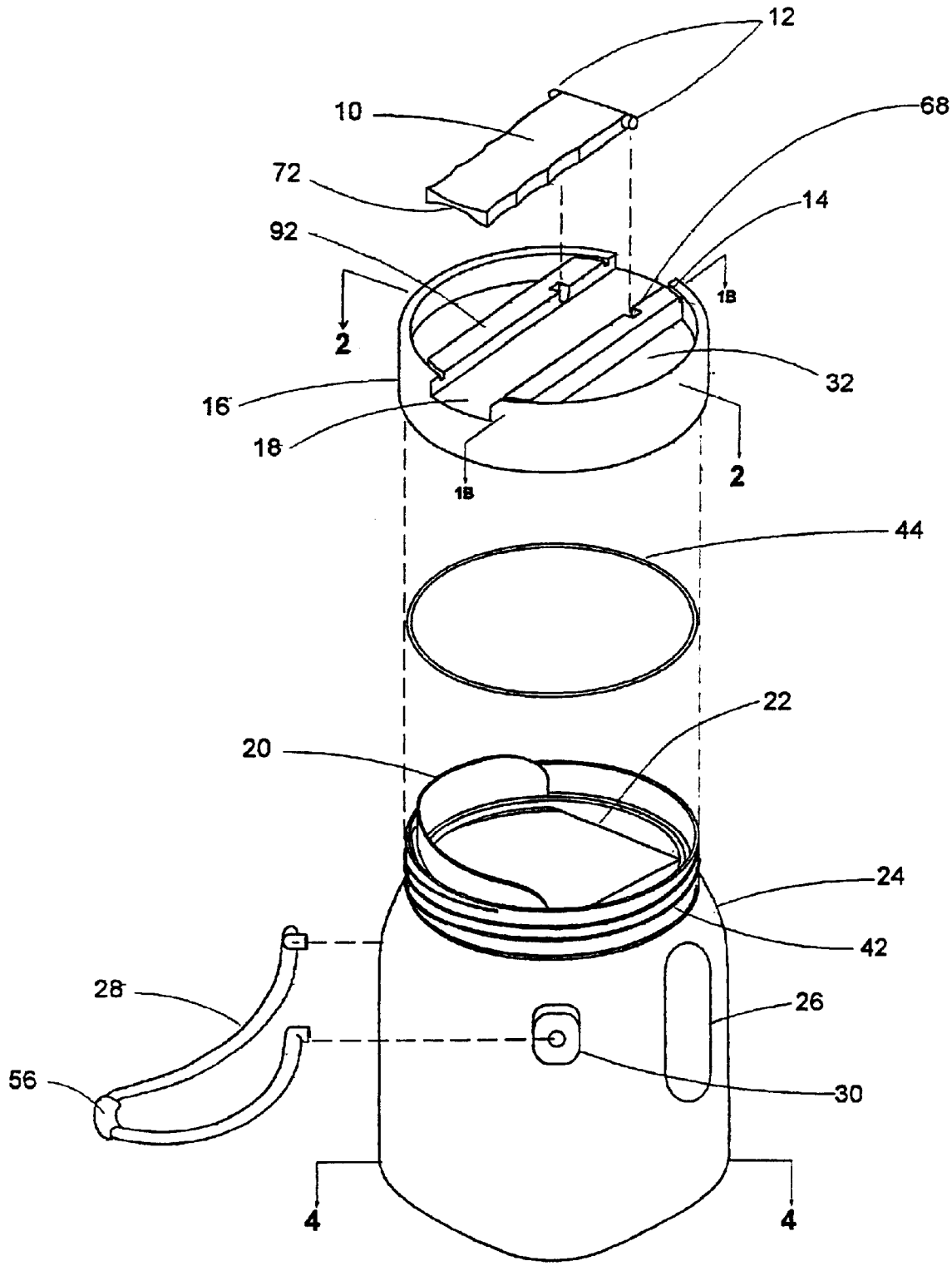
FIG. 1 is an isometric view of the container main parts and features as shown from one side in exploded form.

A preferred embodiment of the present invention is illustrated in FIG. 1 in exploded part format. The container has a jug-like body 24, preferably of one-piece plastic construction. The jug body may be blow-molded and made of high-density polyethylene (HDPE), and can be made resistant to oil-based materials and the like by treating the interior with a process such as fluorination. It has a plastic screw-type lid 16, a flip handle 10 with two cylindrical, mounting hinge pins 12 protruding from its sides on one end. Both the lid and flip handle can be made of commonly available strong, plastic materials such as HDPE, ABS or PVC. Both can be injection molded or fabricated from stock. The preferred embodiment of the container also has a rigid swing handle 28 externally mounted onto the body at its ends, and an optional swing handle grasp pad 56 which fits around the middle of the swing handle. The swing handle is made of strong, corrosion-resistant metal such as aluminum or stainless steel. The grasp pad is made of a soft, resilient plastic or dense foam rubber-type material, and is installed either by sliding over the end of the handle or through a slit in the grasp. The swing handle is contoured so that it conforms to the outside of the jug body when it is in the downward position, and so that it has a comfortable location from which to carry the container when it is in the downward position, and so that it has a comfortable location from which to carry the container when it is in the upward position. The swing handle is contoured to provide good access to the body opening when it is in the upward position.

Figure 1B:
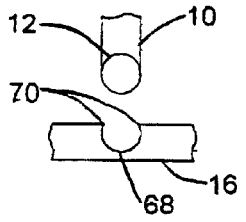
FIG. 1B is a detailed view of the flip handle attachment point.

The top of the lid is shown provided with two integral hinge slots 68 in which the hinge pins of the flip handle are assembled. The top of the lid has a recessed handle trough 18, in which the flip handle sits when assembled with the lid. The trough is formed between a set of trough rails 92. The top of the lid has a set of stacking grooves 14 cut into the trough rails of the lid. The stacking grooves are at the intersection of the trough rails and an inside shoulder of the lid. The stacking grooves are circular, concentric with the diameter of the lid, and truncated at the edges of the trough rails. The flip handle in the retracted position remains within the diameter of the lid, and does not block the stacking groove. The flip handle may have a matching groove or indentation of sorts to prevent interference with the stacking groove. The flip handle pivots up to 180 degrees about its hinge pins when assembled in the lid, so that in the flipped-open position the handle protrudes from the outside of the lid and can be used as a lever to turn the lid. FIG. 1B is a cross section view of the hinge slots showing each has a smaller opening 70 than the diameter of the hinge pins, so that the pins can be snapped into the slots and become trapped.

Figure 2:
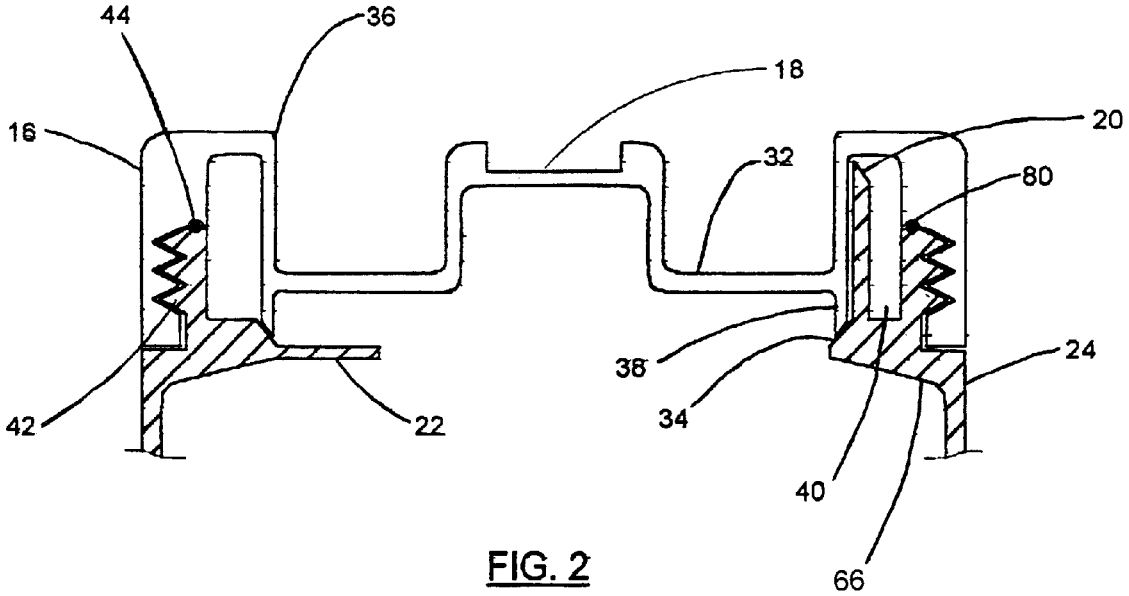
FIG. 2 is a cross section of the lid and upper container body in the closed state.

FIG. 2 shows a cross section of the lid and jug upper body in the assembled state. The outer walls of the handle trough and the outside diameter wall of the stacking groove extend downward and meet with a horizontal surface at the bottom to form a deeply recessed lid top 32. The recessed lid top is deep enough to facilitate gripping by a hand for the purpose of manually turning the lid.

The flip handle is wide and thick enough to withstand a lateral force used to unscrew the lid from the body. The flip handle is shown having rounded edges for user comfort. The flip handle, for example, may have an approximately 1–2 mm deep access cut 72 at the end opposite the hinge pins, and on the side of the handle which rests on the bottom of the trough. The access cut enables a finger or tool to be placed underneath the end of the flip handle to pull it up. The flip handle width is slightly smaller than the width of the handle trough. This is provided to prevent binding in the trough, yet to provide for transfer of applied turning force directly through the sides of the handle to the lid instead of to the hinge pins.

Figure 3:
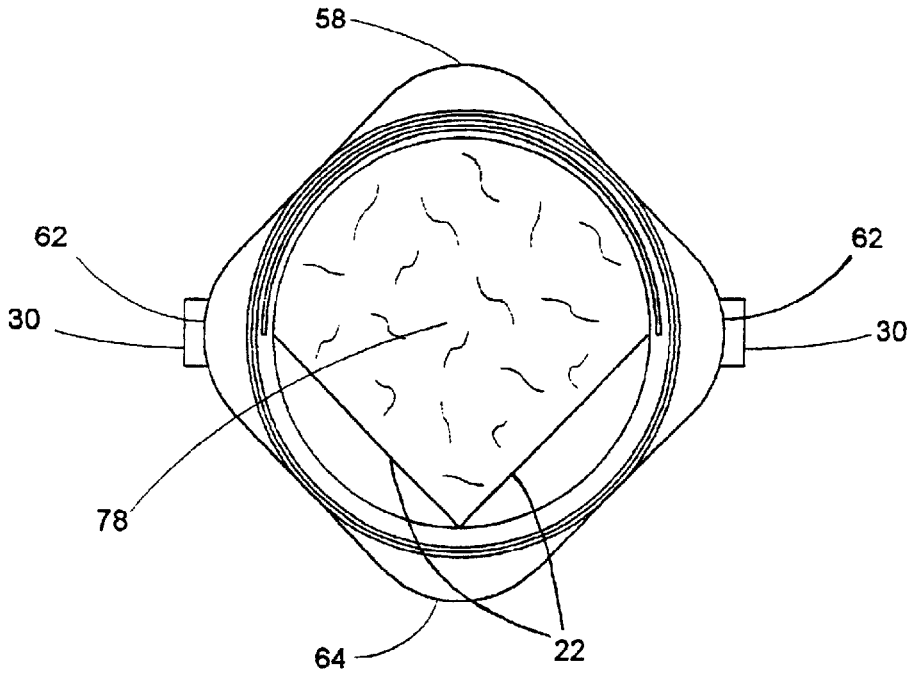
FIG. 3 is a top view of the container with the lid removed, front of the jug at the top of the figure.

The container body 24 is also illustrated as provided with an integral, hollow handle 26 recessed to fit within the overall shape of the body, FIG. 3 shows the preferred overall shape of the jug body. The integral handle is shown to be within the cross section of the rounded square shape formed by the jug body. This provides an efficient overall shipping and shaking volume of the container. The preferred cube shape does not take any more box space than a cylindrical container of the same height, but it contains more volume.

Figure 1C:
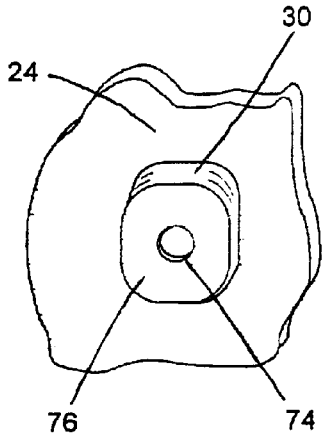
FIG. 1C is a detailed view of the rigid handle ear attachment.

In FIG. 3, rounded corners 58,62,64 of the body are shown provided, thus making the lower body cross-section a rounded-corner square. The top shape, however, is circular with an external threaded collar extension 42. On the outside of the body at corners 62, near the top in the area where the square shape of the body transitions to circular, two handle ears 30 are shown provided. FIG. 3 shows the ears as shaped close to the overall body contour, located slightly offset from the center of the corners. This offset is in the direction of the center of internal volume of the body, which is off center from the overall square shape to adjust for the volume displaced by integral handle at corner 64. A further view of the ears is shown in FIG. 1C, extending from the outside surface of the body, providing a support surface 76 approximately parallel and connected to the body on both sides and the top, but not the bottom of the surface. There is a handle hole 74 in the support surface of each ear. A space between the support surface and the main part of the body provides room for installation of the ends of the rigid swing handle. The ends of the swing handle are bent in an "L" shape, each in the opposite direction of the other, to prevent the handle from falling out of the handle ears once assembled with the jug body.

As before discussed, one of the important novel features of the container construction of the present invention resides in the dripless pouring spout design handle, that can be seen in FIGS. 1 and 2 extending higher than the threaded collar portion of the body. The spout has a smooth or rounded translation at each end, at side corners 62. The top edge of the spout is tapered to a thin edge, approximately 0.2–0.5 mm thick, as shown more particularly in FIG. 2. The taper can be on either or both sides of the top edge of the spout. The spout is located concentrically within the threaded extension of the body, at an approximate radial distance of 2–4 mm in the preferred prototype container of the invention. The space between the spout and the threaded portion of the body forms a deep groove-shaped drip catch 40, around the length of the spout. A conical-shaped, smooth, beveled edge 34 is adjacent to and radically inward from the base of the spout as also shown in FIG. 2. The beveled edge extends around the full circumference of the opening at the top of the jug body. In the opposite half of the circle coincident with the spout, just below the beveled edge, and in the same plane as the base of the spout, are two straight, perpendicular chord wiping edges 22. These wiping edges are shown in FIGS. 1, 2, and 3. The preferred embodiment of the container exemplified in said prototype, has a body opening at the top of the jug body, formed between the wiping edges and the beveled edge under the spout of at least 102 mm. This dimension, however, would vary for a different overall size container of the same design.

The lid has internal threads that mate with the external threads on the collar of the body A circular gasket 44 is used between the lid and jug body near the threads of each member. The gasket is made of a pliable, compressible material such as soft plastic or rubber, and seals the container when assembled. The gasket is installed in the lid and retained there by a tightly conforming gasket groove 80. A flexible, circular splash seal 38 extends from the bottom of the lid radially inside the threads, gasket, and spout, coincident with the outside wall of the recessed lid top. The beveled edge of the jug body forms a mating surface for the splash seal, which is made long enough so that the splash seal will not hit the top of the wiping edge when the lid is screwed on the body. Below the wiping edges on one side and the beveled edge on the opposite side of the opening, the jug body has an inner lip 66 that is a smooth contoured transition from the inside of the body. The lip is shaped so material poured out of the body will not be trapped inside in the upside-down position.

Figure 4:
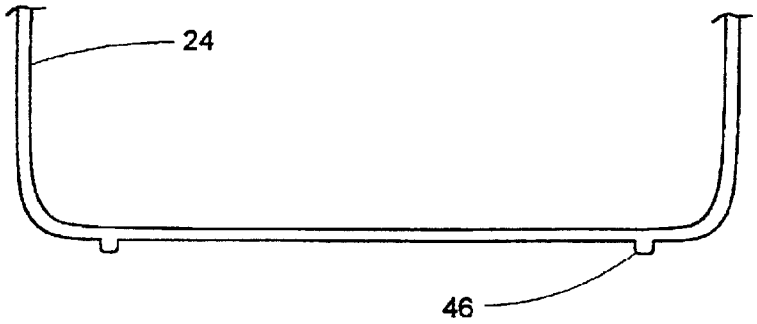
FIG. 4 is a cross section of the bottom of the container.
Figure 4B:
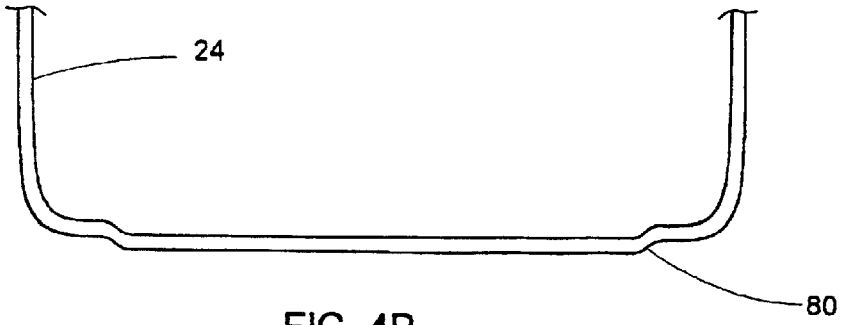
FIG. 4B is a cross sectional view of an integral stacking ring of variant shape.

FIG. 4 shows a sectional view of the bottom of the jug body. A protruding, full circumference integral stacking ring 46 is illustrated as extending from the bottom of the body. The ring is sized and shaped to fit within the stacking groove of the lid. This provides stability when one such container is stacked on top of another, unlike the prior art paint cans. The flip handle is grooved or shaped such that it does not interfere with the integral stacking rings when stacked. The outside diameter of the integral stacking ring is the same as the inside diameter of shoulder 36 such that the contact made increases lateral locking stability.

Operation of the Container—FIGS. 1–6

The container of the invention is well suited for storage and access of viscous fluids. The presence of the rigid swing handle 28 or flexible swing handle 48 and integral handle 26 allows multiple one-handed or two-handed positions when holding or carrying the container, or pouring material from it. The handles also allow for multiple positions, with one hand holding or carrying the container, while accessing the material within it through the jug body opening 78 with the other hand. The shape, size and location of the integral handle also allows different relative positioning of the arm whose hand is holding the handle, either straight on, perpendicular to the container, or at the side, tangential to the container. It also allows for carrying two containers with one hand, if the hand is at least average adult-sized.

The thin edge of spout 20 provides for the minimum amount of spillage from a viscous fluid poured from the container, which will adhere to the back surface of the spout as it is tipped back to an upright position. The combination of the spout extending higher than the threaded extension, and the gap between the spout and the threaded extension at drip catch 40, prevents spillage onto the sealing surface at the top of the extension and onto the threads themselves. This helps to keep them clean for optimal use and storage with the container. Drip catch 40 also provides a reservoir for, and traps such viscous fluids poured from the container, which otherwise would drain down the outside of the spout onto the threads. In order for this arrangement to work properly, however, the drip catch area can not be allowed to contain too much fluid or it would pour out from that area at the same time as the main body when tipped. The function of splash seal 38 is to prevent this from happening.

This splash seal prevents any significant amount of fluid from getting into the drip catch area or on the sides of the threaded extension when lid 16 is on. As the lid is screwed on, the splash seal engages with beveled edge 34 at the same time the lid engages with gasket 44. The gasket compresses as the lid is turned further, providing a seal for the container. As the gasket compresses, the splash seal flexes inward down the beveled edge until the lid is completely seated against the threaded extension. This way, by keeping the drip catch and inside surface of the threaded extension free of fluid material, external threads 42 and gasket 44 will remain clean so long as the container is only tipped to pour material out in the direction of the spout. To illustrate further, if a significant amount of fluid is allowed to get into the drip catch area, this fluid could then pour out over the top sealing surface of the thread extension and onto the threads the next time the container is tipped for pouring. Preventing fluid from getting into those areas, in accordance with the construction of the present invention, allows for shaking the container to mix internal fluids, or for other normal uses, while assuring the gasket sealing surface and threads stay relatively clean.

One way a person can open or close the lid of the container is simply to grasp the lid around the flip handle in the half-moon shaped sections of recessed lid top 32 with one hand, and the integral handle with the other, and turn the lid. Alternately, flip handle 10 assembled in the lid is used for leverage in manually screwing the container open or closed. First a person uses a finger (or, if available, a small a tool such as a screwdriver) to flip open the flip handle all the way. Then the person grasps the integral handle with the other hand and applies a force to the flip handle while taking the reaction out with the hand at the integral handle. Obviously, the flip handle and recessed handle of the lid can be used concurrently if convenient to do so.

Access to the material inside the container is provided through the opening. Wiping edges 22 are provided for wiping off a brush or the like dipped into the fluid in the container, such that the fluid wiped off the brush or other device, will drain back into the container. The material in the container may also be poured out completely, which is facilitated by an inner lip which provides a smooth geometry that will not trap any fluid in the upside-down container position.

The containers may be stacked on top of one another for storage in a stable fashion, facilitated by the stacking groove 14 in the lid and integral stacking ring 46 on the bottom of the jug body, as before described.

Alternate Constructions

In order to provide a more producible version of the container, it may be desired to make the jug body out of two separate pieces, and then use a commercially available adhesive or fasteners integrally to connect them. One likely separation point is at the interface between the externally threaded extension at the top of the body and the remaining features radially inside it. This corresponding inner piece would consist of the wiping edges, the beveled edge, the spout, and potions of the bottom surface of the drip catch and of the inner lip. The pieces may then be able to be fabricated with other less expensive techniques than blow molding or injection molding or with less expensive tools and machines. Similarly, the lid and flip handle may be fabricated by other means as opportunity allows for improved costs, such as stamping or extrusion.

To provide a stronger hinge pin on the flip handle, it may be desirable to construct it out of a metal material such as stainless steel. In its place, in the handle, would be tight fitting hole, in which two separate hinge pins or one long pin through the handle would be installed.

Figure 5:
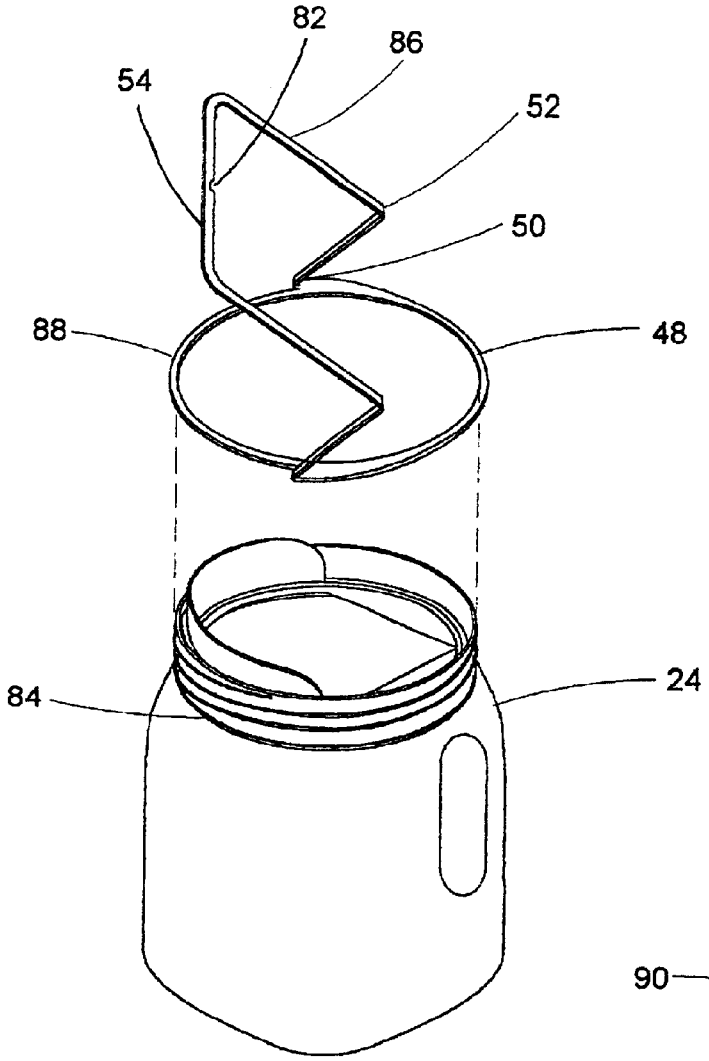
FIG. 5 is an isometric view of the container and a flexible swing handle variant.

FIG. 5 illustrates an alternate embodiment of the container. In this version, a flexible swing handle 48 is mounted at the top of the jug body. The flexible swing handle is made of a thick, flexible plastic such as polyethylene, polypropylene, vinyl, or nylon, which allows for repetitive bending and flexing without yielding or breaking. The flexible handle has a circular base 88 for mounting on the jug body and two parallel legs 86 extending off the base on opposite sides. Each leg has two locally thinned or pre-grooved sections at a base joint 50 and a mid-joint 52 that act as hinges and allow the handle to lay down on the side of the body when it is at rest. It has a straight, integral, swing handle grasp 54 connecting the two legs with a small indentation or curved notch 82 in the center of the grasp. The notch can be used to hang the container using a common existing accessory tool used for such purposes, such as a ladder-rung hook. The inside diameter of the base is slightly smaller than the outside diameter of the threaded extension of the body, and mounts in a small circumferential groove 84 just below the threads. The flexible swing handle can be rotated or fixed in its installed position to move the relative position of the handle grasp.

Figure 5B:
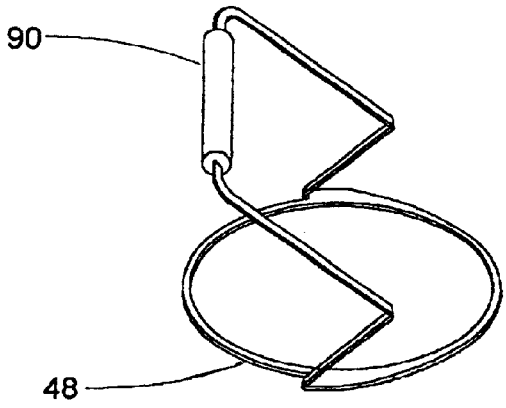
FIG. 5B is an isometric view of a flexible swing handle with a grip pad.
Figure 6:
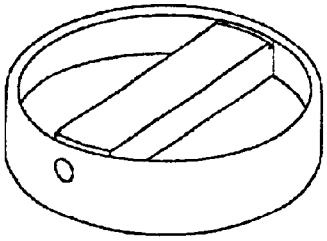
FIG. 6 is an isometric view of a lid variation without a retractable handle and a hole for an opening tool.
Figure 6B:
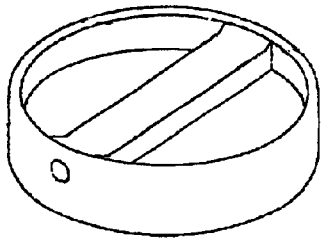
FIG. 6B is an isometric view of a lid variation in FIG. 6 designed to mate with the integral stacking ring variant shown in FIG. 4B.
Figure 6C:
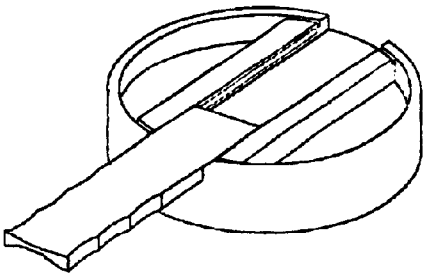
FIG. 6C is an isometric view of a sliding retractable handle variant.
Figure 6D:
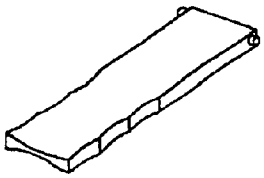
FIG. 6D is an isometric view of the handle shown in FIG. 6C.

The same flexible swing handle is shown in FIG. 5B with an optional flexible handle grasp pad 90 installed similarly to the swing handle grasp pad that was described in the main embodiment version. The operation of these alternate swing handle versions is similar to that previously described. The flexible handle may be rotated in its installed position to change the position of the handle grasp relative to the spout, jug body opening, or other features in the jug body. The handle grasp can be neatly stowed against one of the flat sides of the jug body when in the downward resting position.

Further modifications will also occur to those skilled in this art, and such are deemed to fall within the spirit and scope of the invention as defined in the appended claims.

What is claimed is:

1. A paint container for storing and dispensing fluid paint, said container comprising: a body of predetermined cross-dimension for holding the fluid paint, a top circular externally threaded collar joined to the body and having an enlarged opening extending therethrough, and an interiorly threaded lid of substantially the same cross-dimension as the body for threaded engagement with the collar, the collar being interiorly provided with a fixed integral substantially semi-circular concentric thin spout spaced inwardly thereof with a depending concentric drip-catch groove gap therebetween and along the spout, the spout extending upwardly above the collar to enable pouring of the fluid paint over the spout rearwardly of the collar threads, but with the height of such extension accomodatable within the lid when in threaded closure engagement with the collar to seal the fluid paint in the container body.

2. The container of claim 1 wherein the body, collar, spout and groove are formed of unitary plastic materials.

3. The container of claim 1 wherein planar wiping edge extensions are provided unitarily with and inwardly from the collar in the semi-circular region opposite the spout.

4. The container of claim 3 wherein the wiping edge extensions are provided in the form of integral planar chords the inner edges of which are perpendicular to one another.

5. The container of claim 1 wherein a circumferential beveled edge is provided radially inwardly from the base of the spout for mating with a circumferential depending splash seal on the lid such that the container contents are isolated from spout, drip catch and lid seal.

6. The container of claim 1 wherein a circumferential ring extends from and below the lid and aligns with and forms a secondary seal with the container.

7. The container of claim 1 wherein the top of the lid is provided with a recessed diametrically extending trough within which a handle is mounted to fit within the top surface of the lid in stored position, and to protrude, in open position, outside of the lid as a lever for turning the lid.

8. The container of claim 1 wherein a rigid swing handle is provided externally mounted at its ends in handle ears provided on opposite sides of the body.

9. The container of claim 8 wherein the swing handle is centrally provided with a handle grasp pad.

10. The container of claim 1 wherein the body is cube shaped with rounded corners.

11. The container of claim 10 wherein an integral handle is provided at one corner, and the spout is positioned at the diametrically opposite corner.

12. The container of claim 11 wherein a rigid swing handle is provided externally mounted at its ends in handle ears located at the corner perpendicular to the said one and opposite corners.

13. The container of claim 11 wherein a rigid swing handle is provided externally connected at its ends to diametrically opposite points of a circular base ring mountable at the threaded collar.

14. The container of claim 13 wherein the swing handle is provided with an intermediate handle grasp pad.

15. The container of claim 1 wherein the lid is provided with a circumferential groove for receiving a stacking ring of another container provided to extend from the bottom of the body of the other container to enable stable stacking.

16. In a fluid paint container of predetermined cross-dimension having a top circular externally threaded collar of substantially the same cross-dimension a method of enabling substantially dripless removal of fluid paint from within the container, that comprises, positioning a thin semi-circular cylindrical spout concentrically inwardly of and integral with the collar, with a drip-catch groove gap formed along the base of the spout between the spout and the collar, and extending the height of the spout sufficiently above the threaded collar to prevent spillage onto the threads when pouring fluid paint over the spout, and to trap any spillage back over the spout in the drip-catch groove gap.

17. The method of claim 16 wherein the container is sealed by screwing in internally threaded lid of the same cross-dimension onto the collar threads, and with said height of the spout being limited so as to fit within the lid when sealed.

18. A paint container for storing and dispensing fluid paint, said container comprising: a body of predetermined cross-dimension for holding the fluid paint, a top circular externally threaded collar joined to the body and having an enlarged opening extending therethrough, and an interiorly threaded circular lid of substantially the same outer cross-dimension as the body for threaded engagement with the collar, the collar being interiorly provided with a substantially semi-circular concentric thin spout spaced inwardly thereof and extending upwardly from a lower interior concentric semi-circular beveled edge of the collar of less diameter than that of the spout, and with a depending concentric drip-catch groove gap disposed between the spout and the collar threads, the spout extending upwardly above the collar to enable pouring of the fluid paint over the top of the spout rearwardly of the collar threads, but with the height of such extension accomodatable within the lid when in threaded closure engagement with the collar, and the lid being interiorly provided with a depending circular splash shield of diameter such as to engage said beveled edge when the lid is in such thread engagement with the collar, thereby to enable sealing the fluid paint in the container body.

19. The paint container of claim 18 wherein a sealing gasket is provided near the top of the external collar threads for sealing against a corresponding underside region of the lid near the top of the interior lid threads upon such threaded closure engagement with the collar.

20. The paint container of claim 18 wherein the collar is interiorly provided opposite said semi-circular spout and semi-circular beveled edge, with perpendicular chord wiping edges, the opening defined between said beveled edge and the chord wiping edges providing the access to the paint within the container body.

21. The paint container of claim 18 wherein the body is of cube-shaped blow-molded plastic with the lower body having rounded corners.

22. The paint container of claim 18 wherein the circular lid is of rigid plastic interiorly circularly recessed to provide annular outer hollow shoulders for receiving the spout and collar threads and that facilitates manual turning of the lid.

23. The paint container of claim 22 wherein said recess is provided with a diametrically extending central trough and flip handle for facilitating lid turning.

24. The paint container of claim 22 wherein the lid recess is provided with an outer circular groove for accommodating a circular stacking locator ring provided on the bottom of the container.

25. A consumer paint product comprising:

(a.) a plastic body defining an interior volume, said body comprising:
- a bottom portion including a bottom wall and at least one side wall; and
- a top cylindrical collar portion centered above and joined to the bottom portion, said collar portion having an enlarged opening extending therethrough for accessing the interior volume and including a peripheral exterior surface with a thread formed therein;

(b.) an architectural paint composition disposed in the interior volume of the body; and (c.) a pouring guide disposed in the collar and including an arcuate pour spout spaced inwardly from the collar so as to define a drip catch groove therebetween, said pour spout extending upwardly above the collar to enable pouring of the paint composition over the collar; and (d.) a cap having an interior thread for mating with the thread of the collar to secure the cap to the collar, over the opening, said cap having substantially the same lateral cross-dimension as the bottom portion of the body and having an interior height sufficient to accommodate the pour spout when the cap is secured to the collar.

26. The consumer paint product of claim 25, wherein the opening extending through the collar has a lateral dimension of at least 102 millimeters.

27. The consumer paint product of claim 26, wherein the opening extending through the collar has a lateral dimension of at least 125 millimeters.

28. The consumer paint product of claim 25, wherein the pour spout is semi-circular and is concentric with the collar portion.

29. The consumer paint product of claim 28, further comprising at least one planar wiping extension disposed within the collar, said at least one wiping extension being spaced from the pour spout and having at least one inner edge against which a paint brush may be wiped.

30. The consumer paint product of claim 29, wherein the at least one planar wiping extension comprises a pair of planar wiping extensions having inner edges that are perpendicular to each other.

* * * * *